US005852102A

United States Patent [19]

Thyssen

[11] Patent Number: 5,852,102

[45] Date of Patent: Dec. 22, 1998

[54] BINDER COMPOSITION FOR PREPARING FIBER MATS

[75] Inventor: Stan Thyssen, Waalre, Netherlands

[73] Assignee: Teodur N.V., Breda, Netherlands

[21] Appl. No.: 737,049

[22] PCT Filed: Apr. 29, 1995

[86] PCT No.: PCT/EP95/01643

§ 371 Date: Jan. 28, 1997

§ 102(e) Date: Jan. 28, 1997

[87] PCT Pub. No.: WO95/30034

PCT Pub. Date: Nov. 9, 1995

[30] Foreign Application Priority Data

May 3, 1994 [DE] Germany ..... 44 15 470.4

[51] Int. Cl.[6] ..... C08L 51/00

[52] U.S. Cl. ..... 524/540; 524/494; 524/541; 524/542

[58] Field of Search ..... 524/540, 541, 524/542, 494

[56] References Cited

FOREIGN PATENT DOCUMENTS

| | | |
|---|---|---|
| 0 363 539 | 10/1988 | European Pat. Off. . |
| 0 376 432 | 6/1989 | European Pat. Off. . |
| 3833656 | 10/1988 | Germany . |
| 55 148266 | 11/1980 | Japan . |
| 55148266 | 11/1990 | Japan . |
| WO95/21213 | 8/1995 | WIPO . |

OTHER PUBLICATIONS

International Search Report

*Primary Examiner*—Edward J. Cain
*Attorney, Agent, or Firm*—Pillsbury Madison & Sutro LLP

[57] ABSTRACT

A mixture for producing moulded articles from fibre mats containing a) 20 to 45 wt. % of a powdered binder mixture, b) 80 to 55 w. % of organic and/or inorganic fibres, characterised in that the powdered binder mixture contains a1) 30 to 90 wt. % of phenol resin and a2) 70 to 10 wt. % of powder coating waste and moulded articles produced therefrom.

13 Claims, No Drawings

BINDER COMPOSITION FOR PREPARING FIBER MATS

This application is a 371 of PCT/EP95/01643 filed Apr. 29, 1995.

FIELD OF THE INVENTION

The invention relates to a special binder composition for preparing fibre mats and a method for its preparation. The prepregs produced from the fibre mats and binders are also described.

BACKGROUND OF THE INVENTION

Moulded articles based on fibre mats are used extensively in industry. These consist of a matting made of fibres of various kinds which can be mixed with binder. Intermediates can then be produced from these fibre mats, so-called prepregs, which are then moulded with the appropriate processing mould, cured and optionally backed. Likewise, it is also possible to prepare corresponding continuous fibre mats directly from the fibres and binder powders. These moulded articles or sheet products are used in a wide range of areas. In the automobile industry, for example, these products are used as moulded articles, e.g. as insulating material for engine bonnets, as wheel arches or as boot insulation. Another field of use is application as sheet products, e.g. as insulation in washing machines, tumble-driers or loud speakers, in sound-absorbing walls. They may also be provided with further coatings, e.g. by flock spraying, backing or laminating. These moulded articles or sheet parts thus provided with an optically stable and decorative surface coating can then be used e.g. as door side panels, as rear parcel shelves or as roof panels in the automobile industry.

The methods for preparing fibre mats and for mixing these mats with binder powder are known. In these, the fibrous material is homogenised, e.g. in a fibre mixing chamber, and laid out as a loose fibrous layer on a conveyer belt.

The binder mixture is then applied to the fibrous material, e.g. with feed rolls or vibrating chutes. Then the fibre/binder mixture is swirled using a current of air in a sealed system and homogenously mixed. The homogeneous mixture of fibres and binder powder is laid out to give a continuous mat. The components in this mixture may then either be stuck together by slightly warming and then cooling, wherein prepregs are produced, or produced as sheet or rolled up products which are already fully cured. The prepregs are not finally cured but they are storage-stable. After processing in the final mould, these prepregs are thermally cross-linked under the effects of heat, at up to 210° C., wherein three-dimensional thermoset moulded articles are obtained.

The demands placed on these moulded articles with respect to surface structure and colour are variable, but adequate mechanical stability must be provided at elevated temperature or under long-term stress. A binder must be used when preparing them, however, which binds together the fibre mats used so well that a stable moulded article is obtained after the final moulding and curing procedures. The binders currently used are relatively expensive. In addition, phenol resins are hazardous to health. The industry is extremely interested in reducing the costs. Alternatives to the expensive, technically pure resins are being sought in particular for the moulded articles described above such as insulating materials for car bonnets, for wheel arches and for other insulating materials.

SUMMARY OF THE INVENTION

The present invention provides a binder mixture for producing fibre matting moulded articles in which a considerable part of the conventionally used pure resins can be replaced by another component which nevertheless leads to stable, reactive binder mixtures which are suitable for producing fibre matting prepregs or cured fibre mats. The invention also provides a reduction in the proportion of substances hazardous to health. These binder mixtures have to satisfy the conventional requirements for the production of fibre matting moulded articles and thus produce cured, stable moulded articles which can be adapted to a wide variety of applications.

It has been shown that this object can be achieved by the use of powder coating waste as or in binders for producing moulded articles from fibre mats. Surprisingly, it was found in fact that conventionally used resins can be replaced to at least a considerable extent by powder coating waste.

One object of the invention is a mixture for producing moulded articles from fibre mats, containing a) 20 to 45 wt. % of a powdered binder mixture, b) 80 to 55 wt. % of organic and/or inorganic fibres, which is characterised in that the powdered binder mixture contains a1) 30 to 90 wt. % of phenol resin and a2) 70 to 10 wt. % of powder coating waste.

A further object of the present invention is use of the powder coating waste to produce moulded articles which contain fibre mats.

A further object of the invention is use of this lacquer waste to bond fibre mats.

DETAILED DESCRIPTION OF THE INVENTION

Powder coatings are being-used to an increasing extent in the lacquer industry. This has the advantage that a solvent-free application process can be used. Emissions to the environment can thus be greatly reduced. The application methods for powder coatings, however, have the disadvantage that a considerable proportion of the powder does not reach the object being coated. This powder is collected in the lacquering cubicles as so-called overspray. Powders are sensitive with regard to distribution of particle size and purity. Therefore this overspray has to be disposed of as waste. In the last stage of powder coating production, the crushed powder coating extrudates are milled. Fine dust is produced during this milling process which can interfere with the lacquering process. Therefore, this dust is largely removed. This dust is very difficult to reprocess and has to be disposed of as special waste.

The fibres which can be used for the various fibre mats are woven, felted or blended fibres. The fibres consist of known materials, e.g. natural, organic and inorganic fibres. Examples of these are glass fibres, mineral wool fibres, polyester fibres, acrylic resin fibres, polyolefin fibres, wool fibres, cotton fibres, flax fibres or the like. Textile fibres, in particular cotton fibres, e.g. fibre waste from the textile industry, are preferably used. These fibres or the fibre mats therefrom are known in industry. Also known are the processes by which they may be produced. This takes place, for example, by weaving or felting. The fibre mats produced should be essentially dry, they may optionally be impregnated with additives.

The phenol resins which can be used in the mixtures according to the invention are conventional reactive phenol resins which have been known in the industry for a long time. Examples are reactive, non-cross-linked, OH groups containing powdered resins. Such resins were already used for the preparation of prepregs from fibre mats. As an example, phenol resins based on phenol and formaldehyde such as are known, for example, as resols or novolaks, may be used. These resins may contain condensation products of formaldehyde as possible cross-linking agents.

These resins have already been extensively described in the literature, e.g. in R. N. Shreve, "The Chemical Process Industries", Chapt. Plastics, 1945 and are commercially available. Further phenol resins are also described in DE-A-38 33 656, EP-A-0 369 539 and EP-A-0 376 432. Phenol resins of the novolak type are particularly preferred.

The reactivity of phenol resins is determined by the type and amount of cross-linking agent used. In general a cross-linking reaction occurs at between 120° and 222° C.

The resins are generally present as powders. Suitable particle sizes are for example, between 0.1 and 500 μm, preferably between 2 and 150 μm, in particular between 10 and 60 μm.

The particle sizes of the powder coating waste are, for example, in the same range as that of the resins and are preferably between 1 and 300 μm, in particular between 10 and 60 μm. If powder coating waste is used where the particle sizes are too small for the desired application, it is possible to obtain larger particle sizes by caking the particles.

The powder coating wastes which can be used according to the invention are those from conventional, known powder coatings. The binders in the powder coatings may be, for example, based on epoxide resins, polyester resins, polyurethane resins or acrylate resins. These powder coating wastes are produced for example, as overspray from lacquering cubicles or as reject batches during the production of powder coatings. Furthermore, it is possible to collect and use filter dusts as well as residues from the milling of powders.

The powder coating wastes which can be used in the mixture according to the invention are not cross-linked. They contain reactive groups such as, for example, carboxyl groups, epoxide groups, hydroxyl groups, amino groups, amide groups or isocyanate derivatives. These can react with each other when heated. The cross-linking temperature depends on their structure. Generally it is between 120° and 220° C. Powder coatings with cross-linking temperatures higher than 180° C. are preferably used in only small amounts in order to achieve the fullest possible extent of cross-linking for the binder mixture used at curing temperatures for the moulded articles of about 160° C. In addition, at elevated cross-linking temperatures, in particular when using fibre mats made from plastics fibres, there is a risk that the fibres may be degraded, which leads to a decrease in the stability of the moulded article. The powder coating/cross-linking temperatures are preferably below 160° C.

The powder coatings used are known binder systems. They are conventional resins based on, for example, epoxides, polyesters, polyurethanes or acrylates.

Epoxide powder coatings contain epoxide resins as the main binder component. These frequently cross-link via hardeners which contain hydroxyl groups, in particular amide or amine groups.

Furthermore, polyester powder coatings are known, in which the main binder constituents are carboxyl-containing polyesters. Proportions of cross-linking agents which are present are, for example, cross-linking agents which contain epoxide groups or cross-linking agents which contain amino or amide groups. In this case it is conventional that each cross-linking agent has more functions than the main binder component. If epoxide/polyester mixed powders are used, so-called hybrid systems, then approximately equal amounts of polyesters and epoxide resins are present.

Polyurethane powder coatings are based on hydroxyl-containing polyesters which can be cross-linked via reversibly blocked polyisocyanates which can be protected with, for instance, known capping agents such as caprolactam or ketoxime, or are present as the uretdione.

Coating powders of the acrylate type are in general mixtures of two or more acrylate resins, each of which contains functional groups such as epoxide groups, carboxyl groups, hydroxyl groups or isocyanate groups. Here, the groups which can react with each other are distributed on different molecules.

These binder powders are described in, for example, S. T. Harris, "The Technology of Powder Coatings", 1976 or in D. A. Bate, "The Science of Powder Coatings" vol. I, 1990.

Colourless or pigmented powder coatings may be used, wherein conventional, known, inorganic or organic coloured pigments may be used as pigments. It is also possible to incorporate special effect pigments, e.g. metal pigments, in the powders. Separation by shade of colour is not required. The degree of fineness of the powder is not an essential factor, care should be taken only that in general an average sample of the different powder residues is used for producing the binder mixture. This leads to better mixing behaviour and to a more uniform production of binder mixture.

Any individual powder coatings may be used. In order to achieve as constant as possible a composition for binder mixture a), a mixture of epoxide powders and polyester powders is preferably present as a2). Here, up to 60 wt. %, preferably up to 30 wt. %, of a2) may optionally be replaced by polyurethane powder and/or polyacrylate powder. In this case it is possible to prepare directly a mixture a2) within the desired ratios by weight and to store it in this form. Another possible mode of working is to store the different powder coating components of the chemical types described above separately and only later to mix these with the phenol resins prior to further processing. Within these chemical types, the materials produced are mixed homogenously, i.e. thoroughly mixed samples are produced with regard to distribution of particle sizes, composition and pigmentation. The powder coating binders produced from the mixtures present in this form are then mixed in the relevant amounts required for preparing binder powder a). Optionally, it is possible to incorporate further additional cross-linking agents in the binder mixture.

The powder coating wastes which can be used according to the invention are present as millable powders. Optionally, it may be required to mill a proportion of the binder which is present in a relatively coarse form to a suitable particle size beforehand. This size may be of the order of magnitude given for the phenol resins.

Conventional additives or auxiliary agents may optionally be added together with the powders. These may be, for example, catalysts, accelerators or flame retardant agents. The catalysts used are preferably tin compounds such as dibutyltin dilaurate, carboxylate salts such as lithium benzoate, quaternary ammonium compounds such as tetrabutylammonium bromide, cetyltrimethylammonium bromide, benzyltrimethylammonium chloride, benzyltriethylammonium chloride or tetramethylammonium chloride or tertiary amines such as triisopropylamine or methylimidazole. Suitable accelerators and cross-linking agents are, for example, basic epoxide group containing compounds such as triglycidyl isocyanurate, glycolurils, dicyanodiamide or beta-hydroxylamides. These additives may be added individually as powdered substances. They may also be incorporated as masterbatches mixed with a proportion of binder or they may be added as a mixture with binder powder a1).

Furthermore, flame retardant substances may be incorporated. These are conventional, known substances which are contained in fire retardant coatings. Examples of this type of compound are borates such as sodium borate, phosphates such as ammonium phosphate or sodium phosphate, aluminium hydroxides or oxides; other suitable compounds are, for example, heavy metal containing compounds such as tin oxide compounds or perbrominated or perchlorinated compounds such as tetrabromophenol. Preferably, however, flame retardant substances which do not contain heavy metals or halogens are used. These flame retardant substances are present as powders. They may be incorporated via a separate masterbatch or they may be added via binder powder a1) or a2) each as a homogeneous mixture with the powder component.

Pigments may also be incorporated in binder mixture a). In general, however, preferably no additional pigments are introduced, only the fibrous fillers in the fibre matting being used or the pigments contained in powder coatings a2).

The present invention also provides moulded articles which can be produced by moulding and partly or completely hardening the mixture of fibres and binder described above. If the mixtures of fibres and binder are only partly hardened, so-called prepregs are obtained which can then be fully cured by placing them in their final mould and heating in a further processing step. If the mixtures are completely cured, then they are moulded into the corresponding shape in a manner known per se and cured at cross-linking temperatures suitable for the binder mixture.

The prepregs formed prior to curing or the finished moulded articles contain in general 55 to 80 wt. % of fibres and 20 to 45 wt. % of binder mixture.

In a preferred embodiment, the binder mixture consists of 45 to 70 wt. % of phenol resins and 30 to 55 wt. % of powder coating binder. The additives and auxiliary agents described above may be contained in an amount of up to 20 wt. %, preferably up to 15 wt. %, wherein the sum of the individual components is 100 wt. %. Any powder coating waste may be used. Only one type of powder coating or a mixture of several types may be used, preferably, however, a mixture of polyester and epoxide resins is used. Furthermore, the preferred ratio of polyester powder to epoxide powder is 0.2:1 to 7:1, preferably 0.8:1 to 3:1. When selecting the powder coating waste, however, care should be taken that these possess an adequate number of reactive groups.

To produce moulded articles according to the invention, the binder mixtures are homogenised and applied to the fibre matting, optionally together with additives. This takes place using known methods. The binder mixture is distributed uniformly on the fibre matting and a heating step is then optionally performed. This softens the binder particles at the surface and bonds them firmly to the fibre matting. This produces so-called prepregs which are storage-stable, still mouldable strips of fabric. In this case, care must be taken that complete cross-linking does not occur and that the binder can still be further moulded when heated and can also flow and be cross-linked.

Binder mixture a), the prepregs and also the cured moulded articles have a reduced proportion of free phenols or formaldehyde. Thus, risks due to these health-hazardous substances are reduced. The moulded articles according to the invention can be produced from the prepregs obtained in this way. This takes place using known methods such as thermoforming and/or backing, finally finishing the prepregs. After the prepregs have been placed in an appropriate mould, they are cross-linked by applying pressure and heat. Cross-linking takes place at temperatures of 140° to 200° C. The time taken may be between 10 and 500 seconds, preferably less than 120 seconds. These factors depend on the phenol resin a1) used. The binder powder melts and flows, whereupon the fibres become at least partially embedded and chemical cross-linking of the resin takes place. A cured thermoset material is produced. Depending on the amount of material used and on the compression pressure applied, the moulded articles may contain a proportion of hollow spaces. The density of the moulded articles may be between 50 and 1000 kg/m$^3$. This depends on the amount and type of fibres and binder. The moulded articles produced have various advantages such as good thermal insulation, dimensional stability up to 130° C., good sound insulation and good flexural strength, they are physiologically acceptable and moisture controlling and they are readily further processed.

These moulded articles can also be coated or they can act as supports for other structural components. This takes place, for example, by applying a film to the surface of the moulded article at the same time as the moulded article is being cross-linked and moulded. This is bonded firmly to the surface due to a chemical reaction. Furthermore, it is possible to achieve a special coating for the surface by subsequently backing and laminating films. Processes for backing moulded articles are widely used in industry. They may be performed using the prior art.

Furthermore it is possible to flock spray the surface of the moulded article. In this case, short fibres are applied essentially at right angles to the surface by means of adhesives which then results in a dense, soft surface.

Processes for flock spraying are also known. The moulded articles produced from the materials according to the invention may optionally be lacquered. For this, any known coating agent known in the industry may be used. Smooth glossy surfaces are produced after heating.

The moulded articles coated in this way have an attractive and decorative appearance. Depending on the method chosen, smooth, soft, grained or even chemically resistant coated surfaces may be obtained. The additional use of flame retarding additives can also produce moulded articles which are resistant to fire.

The moulded articles obtained in this way may be used in a variety of industrial areas. In particular, they may be used in the automobile industry e.g. as internal panels for automobile interiors or as sound and heat insulation. Furthermore, the binder mixtures may be used as resins in linings for clutches. These resins may also be used to construct moulds in the foundry industry. The moulded articles produced are distinguished by a high degree of stability and may be moulded in many different ways. They may be used in different applications by adding different additives or by coating the surface.

EXAMPLE 1

A mixture of 48 g of a commercially available powdered phenol resin (novolak with hexamethylenetetramine) with an average particle size of 35 $\mu$m and a cross-linking temperature of 150° C. and 3.4 g of a pigmented powder coating based on commercially available epoxide resin powder, and 10.2 g of a pigmented powder coating based on polyester resins, wherein the powder coatings each have a pigment content of 13%, is homogenised in a commercial mixing unit.

(polyester:epoxide=3:1, 20% powder coating content)

The mixture can be stored for a long time without further loss in reactivity.

EXAMPLE 2

To 70 g of a phenol resin analogous to the one in example 1 is added a previously homogenised mixture of 15.8 g of an epoxide resin powder coating and 14.2 g of a polyester powder coating, both being unpigmented.

(polyester:epoxide=0.9:1, 30% powder coating content)

To this mixture are added 20 g of a flame retardant based on ammonium phosphate, melamine borate and aluminium hydroxide and the mixture is homogenised in a conventional mixing unit. Slight heating up to 40° C. may possibly occur due to the mixing energy. In this case, however, no caking of the various powder coatings should take place.

EXAMPLE 3

To 60 g of a phenol resin according to example 1 are added 21 g of an epoxide resin coating powder pigmented with 10% of barium sulphate and the mixture is homogenised. Afterwards, 30.1 g of a non-pigmented polyester powder coating is added, as well as 0.4 g of tetrabutylammonium bromide, and the entire mixture is then thoroughly homogenised.

(polyester:epoxide=1.6:1, 45% powder coating content)

The mixture is storage-stable over a long period.

The polyester powders or epoxide powders used are filter dusts from the production of powder coatings. These are homogenised and then an average sample of these constituents are used in the examples.

Prepregs are produced from the powders in examples 1 to 3 using a fibrous matting which contains more than 80%. cotton fibres, prepared in as known way. To do this, the fibre mats are homogeneously mixed with the binder powder by mechanical motion and passed through a hot channel (ca. 2–3 min,. 80°–100° C.). Storage-stable prepregs are obtained in which resin and fibre have been bonded together.

The prepregs can be produced differently, depending on the size and resin/fibre content. The crude density, depending on the ultimate application, is between 25 and 75 kg/m$^3$.

Moulded articles are produced from these prepregs. Here, the prepregs are cut into sections, placed in a press in the desired mould and cured there for 100 seconds to 110 seconds at temperatures between 140° C. and 160° C. After curing, thermoset products which are dimensionally stable in the warm are obtained. The density can be affected by the amount of prepregs or by the pressure applied. The resulting cross-linked moulded articles may be flock sprayed in any known way or they may be backed with films.

The moulded articles obtained in this way have an optically homogeneous surface, they are dimensionally stable and have only a small amount of free phenol or formaldehyde.

I claim:

1. A mixture for producing moulded articles from fibre mats containing:

a) 20 to 45 wt. % of a powdered binder mixture, comprising a1) 30 to 90% wt. % of phenol resin and a2) 70 to 10 wt. % of powder coating waste, and b) 80 to 55 wt. % of organic and/or inorganic fibres, wherein the component a2) consists of powder coating waste which is not yet cross-linked, based on at least one member selected from the group consisting of epoxide, polyester, polyurethane and acrylate resins containing reactive groups.

2. A mixture according to claim 1, characterised in that it contains further additives and auxiliary agents.

3. A mixture according to claim 1, characterised in that epoxide resin and polyester resin in a ratio of 1:0.2 to 1:7 are used as the powder coating waste.

4. A mixture according to claim 1, characterised in that at least one flame retardant is added as an additive.

5. Moulded articles obtained by moulding and partially or completely hardening a mixture according to claim 1.

6. A method of using powder coating waste which is not yet cross-linked, said waste being based on at least one member selected from the group consisting of epoxide, polyester, polyurethane and acrylate resins containing reactive groups comprising moulding articles from fibre mats using a mixture, as follows:

a) 20 to 45 wt. % of a powdered binder mixture, comprising a1) 30 to 90% wt. % of phenol resin and a2) 70 to 10 wt. % of powder coating waste, and b) 80 to 55 wt. % of organic and/or inorganic fibres.

7. A method of using powder coating waste which is not yet cross-linked, said waste being based on at least one member selected from the group consisting of epoxide, polyester, polyurethane and/of acrylate resins, containing reactive groups,, comprising bonding fibre mats using a mixture, as follows:

a) 20 to 45 wt. % of a powdered binder mixture, comprising a1) 30 to 90% wt. % of phenol resin and a2) 70 to 10 wt. % of powder coating waste, and b) 80 to 55 wt. % of organic and/or inorganic fibres.

8. A mixture according to claim 2, characterized in that epoxide resin and polyester resin in a ratio to 1:0.2 to 1:7 are used as the powder coating waste.

9. A mixture according to claim 2, characterized in that at least one flame retardant is added as an additive.

10. A mixture according to claim 3, characterized in that at least one flame retardant is added as an additive.

11. Moulded articles obtained by moulding and partially or completely hardening a mixture according to claim 2.

12. Moulded articles obtained by moulding and partially or completely hardening a mixture according to claim 3.

13. Moulded articles obtained by moulding and partially or completely hardening a mixture according to claim 4.

* * * * *